US005791086A

United States Patent [19]

Huang

[11] Patent Number: 5,791,086

[45] Date of Patent: Aug. 11, 1998

[54] HEAT EFFECT WINDOW

[76] Inventor: Hsin-Tsung Huang, P.O. Box 55-175, Taichung, Taiwan

[21] Appl. No.: 813,446

[22] Filed: Mar. 10, 1997

[51] Int. Cl.[6] ..... E05F 15/20

[52] U.S. Cl. ..... 49/7; 49/1; 49/163

[58] Field of Search ..... 49/1, 4, 5, 6, 7, 49/163, 164, 169, 170

[56] References Cited

U.S. PATENT DOCUMENTS

| | | | |
|---|---|---|---|
| 80,672 | 8/1868 | Schnell | 49/164 |
| 523,591 | 7/1894 | Nielsen | 49/164 |
| 1,072,064 | 9/1913 | Wexler | 49/7 |
| 1,114,854 | 10/1914 | Brown | 49/5 |
| 1,846,149 | 2/1932 | Sanders | 49/7 |
| 1,951,628 | 3/1934 | Prost | 49/7 X |
| 2,239,104 | 4/1941 | Kern | 49/7 |
| 2,300,630 | 11/1942 | Norton et al. | 49/1 |

*Primary Examiner*—Jerry Redman

[57] ABSTRACT

A window equiped with heat effect automatic opening device is provided. The window comprises a rectangular casing composed of hollow interior frames, an exterior panel and an interior panel secured to the lower portion of the casing and a tempered glass for covering the upper portion slidably secured into the casing between the panel and suspended from a suspension system which includes a heat effect device therein to automatically open the window when the indoor temperature becomes higher than an infusion point, and a lift device disposed between the glass and the interior panel for manually opening or closing the window. The improvement is characterized in that when comes a fire alarm, the heat effect device will break off to set the glass free to open the window.

6 Claims, 4 Drawing Sheets

HEAT EFFECT WINDOW

BACKGROUND OF THE INVENTION

The present invention relates to windows and more particularly to a sash window which includes a heat effect automatic opening device sensitive to a high indoor temperature up to a predetermined degree. When a house is inadvertently caught fire, the key element of the automatic opening device will be broken to release a suspended upper sash dropping down to automatically open the window.

Typical sash window comprised of an upper sash or exterior sash and a lower sash or interior sash. The sashes are composed of window panes and are opened alternately. However, for the purpose of burglar-proof, the window is normally locked up and the window pane is made from safty glass or tempered glass so that the window is unbreakable. If a fire breaks out, it either prevents people from escaping out of the house or obstruct the fire engine from extinguishing the fire therein, thereby causing heavy loss.

SUMMARY OF THE PRESENT INVENTION

The present invention has a main object to provide a heat effect window which is sensitive to high indoor temperature and automatically opens during a fire.

Another object of the present invention is to provide a heat effect window which is capable of burglar-proof.

Still another object of the present invention is to provide a heat effect window which includes a drain pipe thereunder for preventing the water from leaking into a house.

Accordingly, the heat effect window of the present invention comprises generally a rectangular casing composed of hollow interior frames, an exterior panel and an interior panel which have the size larger than the one second area of the casing and secured to the lower portion of the window, a tempered glass which is also sizeably larger than the one second area of the casing slidably insets into the flame of the casing and suspends from a suspension system which includes pulleys, weights and heat effect device, and a lift device which is operated by manual rotation of a crank wheel to vertically move the glass for normally opening or closing the upper portion of the window.

The present invention will become sore fully understood by reference to the following detailed description thereof when read in conjunction with the attached drawings.

DETAILED DESCRIPTION OF THE PREFERRED EMBODIMENT

Figure 1:
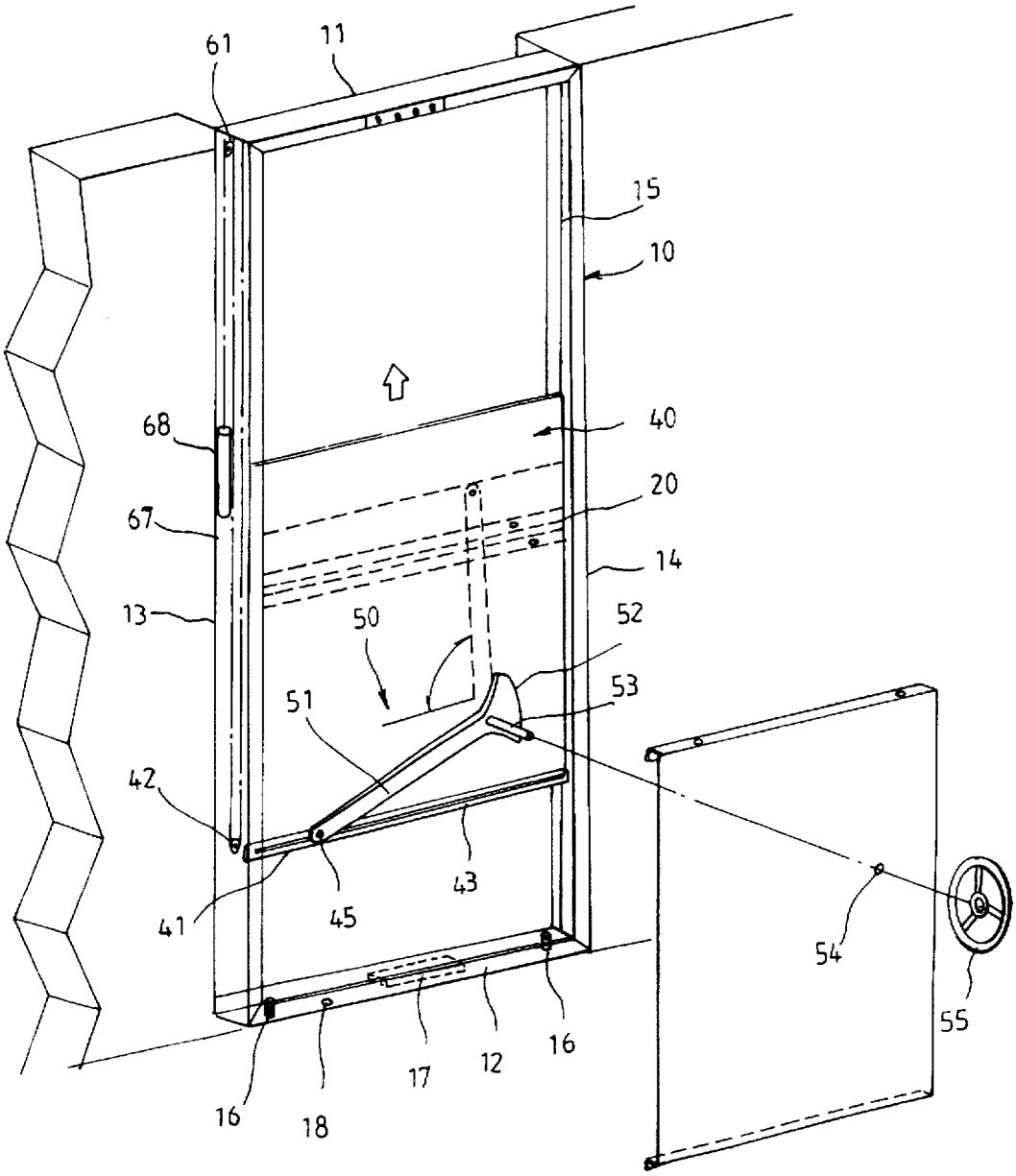
FIG. 1 is an exploded perspective view showing the preferred embodiment of the present invention.

With reference to FIG. 1, the heat effect window of the present invention comprises generally a rectangular casing 10 secured into a concrete or brick wall and composed of the hollow interior rectangular frame which includes a head jamb 11, a skirt 12 and a pair of side jambs 13 and 14 each having an elongated groove 15 combined to receive a slidable tempered glass 40 which has a size lightly larger than one second area of the casing 10, an exterior panel 20 secured to the lower outward portion of the casing 10 and an interior panel 30 releaseably secured to lower inward portion thereof, both the exterior and interior panels 20 and 30 having a size also slightly larger than one second area of the casing 10 wherein the exterior panel 20 has a rough outward surface such as pressed with irregular spots which is attachable to ornamental materials.

Figure 4:
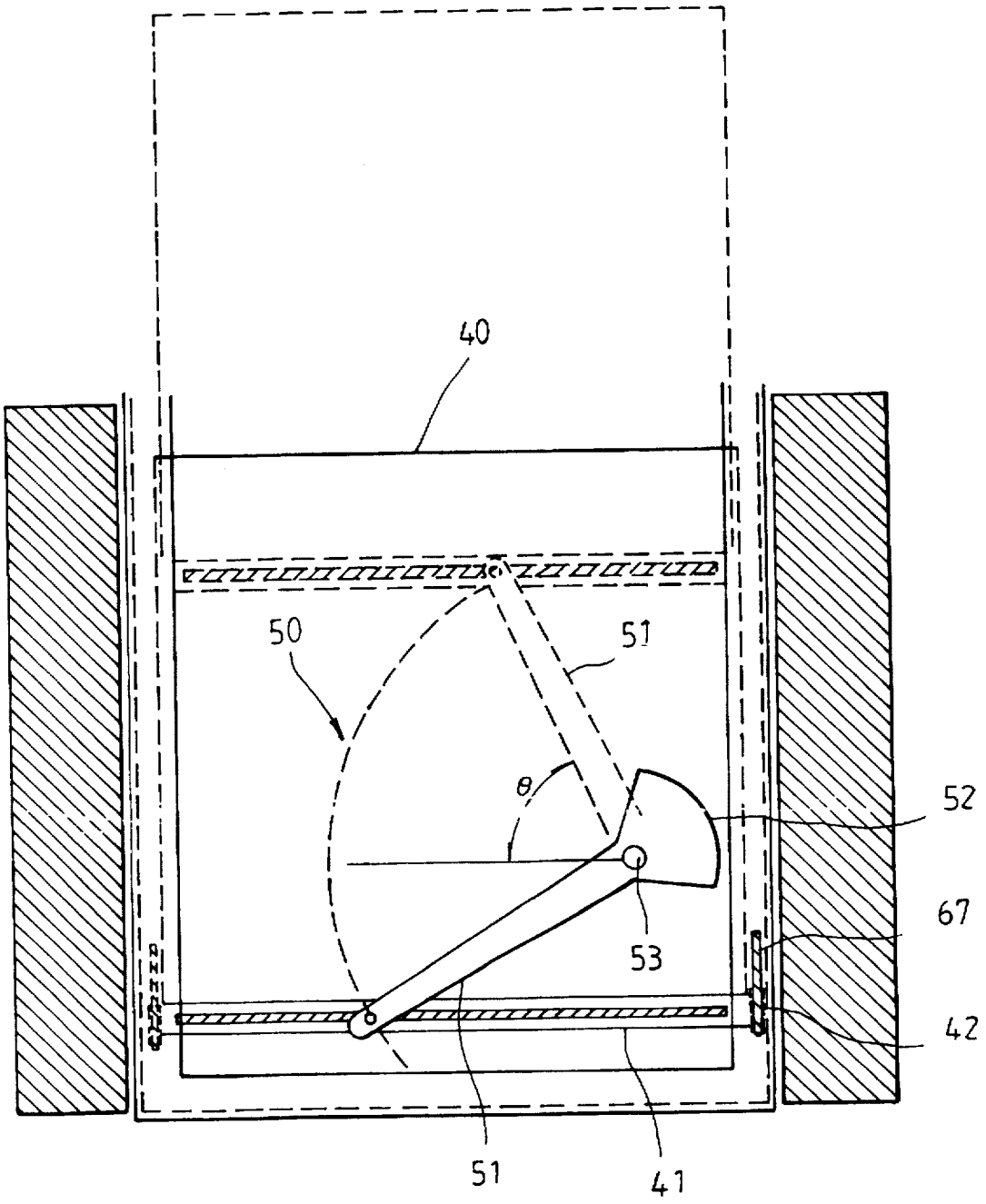
FIG. 4 is an elevational view illustrating the lift device of the present invention.

The tempered glass 40 which normally closes the upper portion of the casing 10 for permitting light and preventing the rain from entered into the housing includes a metal selvage 41 with a rail 43 of roughly C-shaped section thereunder attached to the lower edge of the glass 40 and a pair of first pulleys 42 perpendicularly fixed at two ends of the rail 43 for suspending the glass 40 from a suspension system 60 on the top of the casing 10 (as shown in FIG. 4), and an elongate slot 44 extended longitudinally along the length of the rail 43.

The casing 10 further includes a pair of third spring means 16 and a cushion means 17 disposed in the skirt 12 for providing sufficient flxibility to receive the glass 40 when it drops down, a drain pipe 18 connected to the drainage system of the house formed in the skirt 12 for introducing the rain drips into the drainage system, and an insulator member 19 attached to the inner surface of the outward wall of the head jamb 11, which is provided to prevent any exterior attempt from heating the heat effect device from outside of the house so as to enhance the anti-burglar effect.

Figure 2:
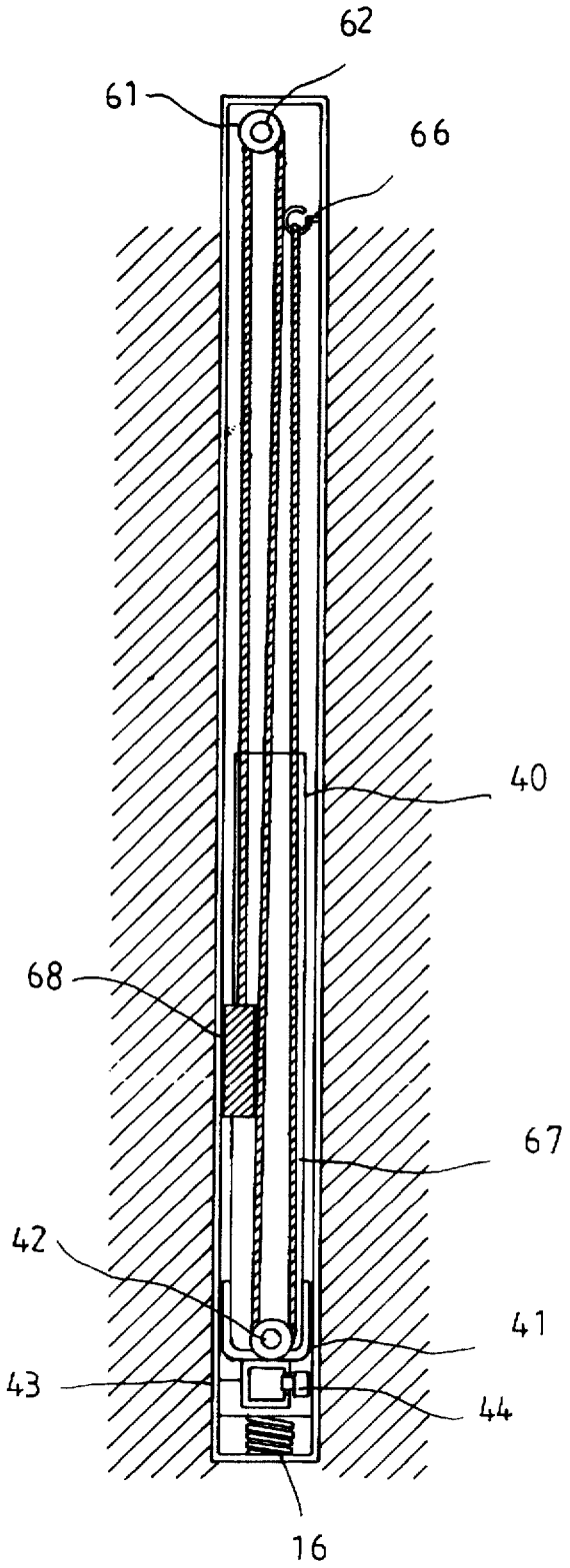
FIG. 2 is a sectional view showing the suspension system of the present invention.
Figure 3:
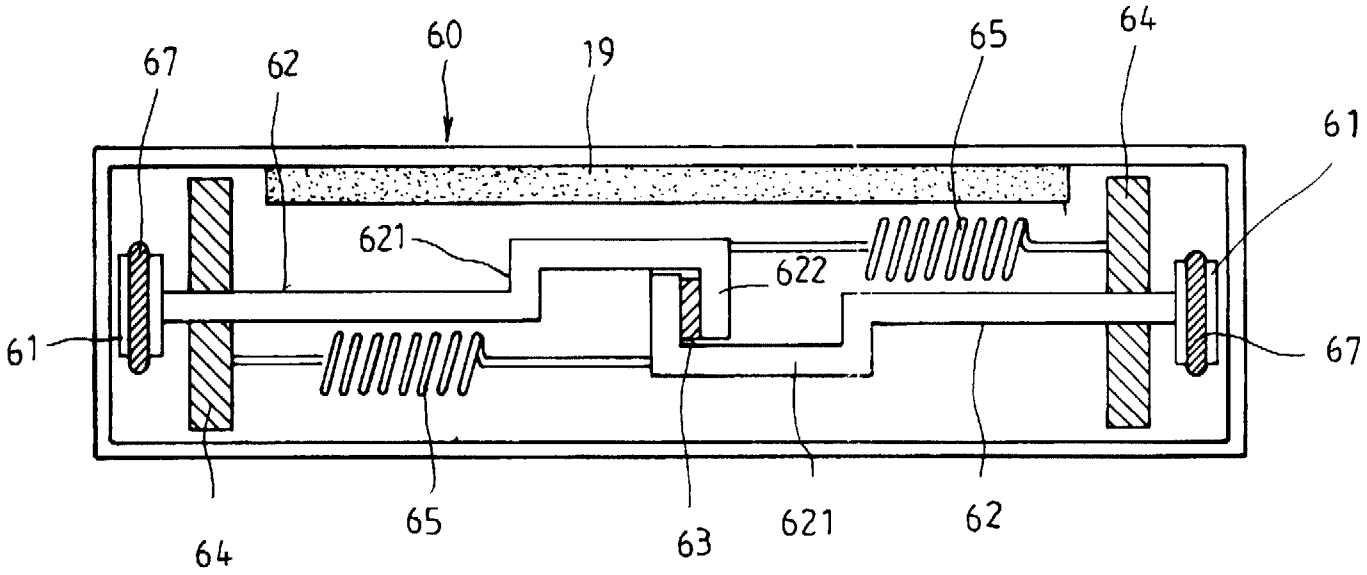
FIG. 3 is a top view showing the heat effect device of the present invention.

Referring to FIGS. 2 and 3, the suspension system 60 comprises a pair of second pulleys 61 positioned inside two ends of the head jamb 11 and embedded in the hollow interior of the pair of side jambs 13 and 14 and releaseably connected by a pair of first and second axle rods 62 each of which has a roughly U-shaped inward end including a distal transverse portion 622 intersected each other and welded on their outward surfaces with low fusion material 63, a pair of first and second journal means 64 attached to the inner wall of the side jambs 13 and 14 respectively for supporting the axle rods 62 and for securing one end of a pair of first and second spring means 65 which have their other ends connected to the outward surface of the distal transverse portion 622 of the U-shaped inward ends of the respective axle rods 62 so as to enable the spring means 65 enforcing the pair of axle rods 62 to potentially toward inward relative to the pulleys and to disengage with the pair of second pulleys 61, a pair of retaining pins 66 respectively secured to an inner wall on the upper portion of the pair of side jambs 13 and 14 for connecting one end of a pair of cords 67 which wind the pair of first and second pulleys 42 and 61 at first then have their other ends respectively connected to a pair of first weight members 68 each of which has a weight equal to one fourth weight of the tempered glass 40 (as shown in FIG. 2).

Referring to FIG. 4 and in view of FIG. 1, a lift device 50 is provided on the interior panel 30 to open and close the window which includes a lever 51 having a perpendicular axis 53 in the proximity of one end rotatably secured to a pivot 54 in a appropriate portion of the interior panel 30 and a crank wheel 55 perpendicular secured to the axis 53 from outside of the panel 30. The other end of the axis 53 pivotally connected to a slide 45 which is sliding in the elongate slot 44 of the rail 43. The lever 51 further has a second weight 52 formed at the end adjacent the axis 53 for concentrating the gravity center of the lever 51 onto the axis 53 which may facilitate a ready rotation of the crank wheel 55.

To close the window, rotate the crank wheel 55 clockwise so that the glass 40 is readily moved upward by the lever 51 because of the weights 52 and 68 which balance the weight of the glass 40. When the glass 40 reaches the head jamb 11, it means that the window is closed and the glass 40 will not drip down because of the first weights 68. However, the lever 51 is tilted to one side relative to the vertical plane and keeps an angle θ slight less than 90 degrees relative to the horizontal line. This arrangement has a purpose to facilitate the glass 40 performing an automatic downward opening.

To open the window, rotate the crank wheel 55 counterclockwise, the glass 40 will gently move down and can stop at anywhere within the lower portion of the window because of balancement established between the glass 40 and weights 68.

When a fire breaks out, and the interior temperature increases up to the infusion point of the low infusion material 63, the welded ends 622 of the axle rods 62 will be broken so as to permit the first and second spring means 65 drawing in the axle rods 62 to disengage with the pair of second pulleys 61 which drop down together with the cord 67 into the interior of the side jambs 13 and 14 because of lost support. Since the glass 40, without support of the suspension system 60, will drop down automatically on the flexible cushion 17 so as to open the window for facilitating people to escape from the house or the fire engine to extinguish the fire from the window.

The insulation member 19 protects the outside of the heat effect device will prevent any exterior heating article attempted by a burglar from damage the device and the drain pipe 18 introduces the rain drips flowing into the drainage system of the house without splashing about the house.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A window equiped with heat effect automatically opening device comprising:

a rectangular casing composed of hollow interior frames which include a head jamb, a skirt and a pair of side jambs each of which has an elongate groove centrally formed of and having an inward surface;

an exterior panel outwardly secured to a lower outward portion of said casing, said exterior panel having a rough outward surface and a size slightly larger than one second area of said casing;

an interior panel releaseably fixed to an inward lower portion of said casing having a size equal to that of said exterior panel;

a tempered glass of a size slightly larger than one second area of said casing slidably engaged into the elongate grooves of said frame between said exterior and interior panels, a metal selvage rimmed on a lower edge of said glass with a rail member of C-shaped section parallel attached thereunder and a pair of first pulleys perpendicularly secured at two ends of said rail;

a suspension system for suspending said glass therefrom, including a pair of second pulleys disposed in two ends of said head jamb and embedded in an interior of said side jambs and releaseably connected by a pair of first and second axle rods which are supported by a pair of first and second journal members attached to an upper inward wall of respective side jambs, said axle rods each having an U-shaped inward end toward each other with a distal transverse portion of the U-shaped inward end intersected each other and having their outward surfaces welded with low infusion material, a first spring means biasedly connected between an inward surface of the transverse portion of the U-shaped inward end of said first axle rod and an inward surface of the second journal member, and a second spring member biasedly connected between an inward surface of the transverse portion of the U-shaped inward end of said second axle rod and an inward surface of the first journal member for enforcing said axle rods potentially toward inward respectively, a pair of retaining pins secured to an upper inward surface of an inner wall of said side jambs for retaining one end of a pair of cords which respectively wind said pair of first pulleys and said pair of second pulleys and then connected on their other ends with a pair of first weight members;

a lift device comprising a lever means having one end pivotally connected to a slide which slids within the elongate slot of said rail, and the other end being a second weight member, an axis perpendicularly projected from an outward surface of said lever in proximity of said second weight member and rotatably secured to a pivot in an appropriate position of said interior panel, and a crank wheel perpendicularly secured to an axis from outside of said exterior panel;

whereby, said glass is normally open and closed by manually rotating the crank wheel of said lift device and is automatically opened by said heat effect device.

2. The window as recited in claim 1 wherein said first weight members each has a weight equal to one fourth weight of said tempered glass.

3. The window as recited in claim 1 wherein said lever of said lift device stops at a position keeping a tilting angle slightly less than 90 degrees relative to a horizontal plane of said window when said tempered glass is in a closed position.

4. The window as recited in claim 1, further includes an insulation member attached to outside of said heat effect device.

5. The window as recited in claim 1 wherein said skirt further includes a pair of third spring means, a flexible cushion disposed spaced apart therein.

6. The window as recited in claim 1, further includes a drain pipe in a lower end of said window for introducing rain drops into a drainage system of a house.

* * * * *